United States Patent [19]

Connor

[11] 4,373,356

[45] Feb. 15, 1983

[54] LUBRICATION SYSTEM FOR ROTARY COMPRESSOR

[75] Inventor: Ralph F. Connor, Knight Township, Vanderburgh County, Ind.

[73] Assignee: Whirlpool Corporation, Benton Harbor, Mich.

[21] Appl. No.: 287,412

[22] Filed: Jul. 27, 1981

[51] Int. Cl.[3] ..... F25B 43/02

[52] U.S. Cl. ..... 62/468; 417/367

[58] Field of Search ..... 62/505, 468; 417/366, 417/367

[56] References Cited

U.S. PATENT DOCUMENTS

| | | | |
|---|---|---|---|
| 2,139,996 | 12/1938 | Buchanan | 62/469 |
| 2,178,425 | 10/1939 | Johnson | 62/505 |
| 2,492,611 | 12/1949 | Zearfoss, Jr. | 62/505 |
| 3,079,763 | 3/1963 | Schneider et al. | 62/84 |
| 3,149,478 | 9/1964 | Anderson et al. | 62/505 |
| 3,317,123 | 5/1967 | Funke | 417/363 |
| 3,606,588 | 9/1971 | Romerhaus | 417/292 |
| 4,006,602 | 2/1977 | Fanberg | 62/505 |
| 4,020,645 | 5/1977 | Pittatore | 62/505 |
| 4,032,264 | 6/1977 | Takahashi | 417/417 |

*Primary Examiner*—Ronald C. Capossela

*Attorney, Agent, or Firm*—Wegner, McCord, Wood & Dalton

[57] ABSTRACT

A lubrication system for use in a rotary compressor wherein the pressurized refrigerant fluid is passed through a precooler and returned to the compressor housing before passing through the discharge line to the refrigeration system. Oil entrained in the compressed precooled refrigerant is passed in heat transfer association with the rear head of the compressor to evaporate therefrom refrigerant vapor which may be entrained in the oil, permitting the oil to be returned to the lubrication sump after such removal for improved lubrication of the compressor. The rear head defines a lubricating oil flow path which, in the illustrated embodiment, opens upwardly from the rear head, permitting the lubricating oil to flow over the rear head for improved heat transfer association therewith in effecting the desired removal of entrained refrigerant vapor therefrom. The oil is delivered to a relatively cool portion of the rear head for flow through the flow path to a relatively hot portion of the rear head, from which oil falls downwardly to a collecting sump.

20 Claims, 5 Drawing Figures

FIG. 1
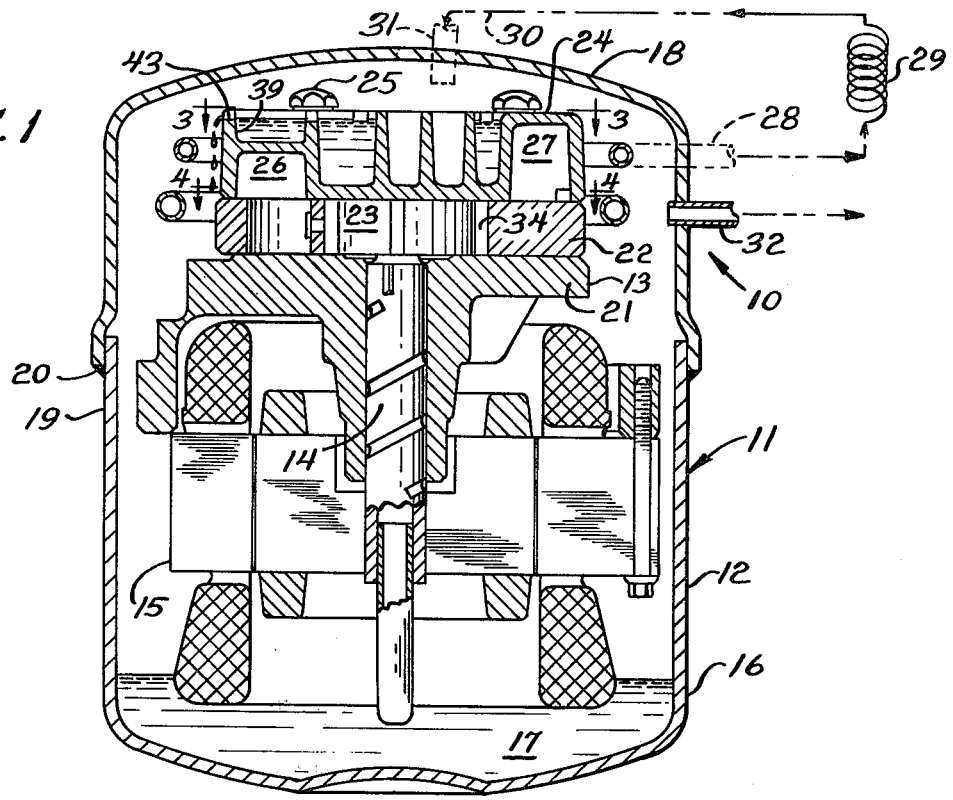
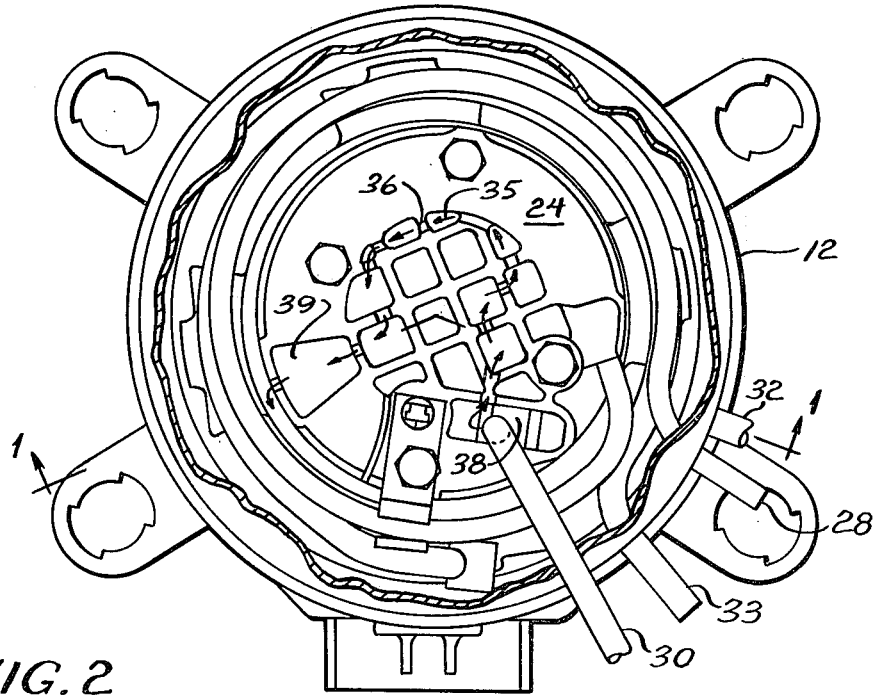
FIG. 2

LUBRICATION SYSTEM FOR ROTARY COMPRESSOR

BACKGROUND OF THE INVENTION

1. Field of the Invention

This invention relates to compressors and in particular to means for cooling a compressor and removing entrained refrigerant vapor from the lubricating oil in rotary compressors.

2. Description of the Background Art

In U.S. Pat. No. 4,032,264 of Shiro Takahashi, a reciprocating electromagnetic compressor is provided with a built-in lubrication mechanism utilizing the flow of refrigerant gas returning to the compressor as means for delivering the lubricant onto the compressor mechanism. Lubricating oil is delivered through a tube leading upwardly from the sump by introducing the refrigerant vapor into the tube at the lower end. The oil is delivered onto the hottest part of the compressor just above the discharge chamber. The oil is then delivered from this portion of the compressor through oil guides to the sliding plane between the piston and the body of the compressor in spaced relationship to the suction chamber.

In U.S. Pat. No. 3,606,588 of Bert W. Romerhaus, which patent is owned by the assignee hereof, refrigerant discharged from the compressor is passed through a precooler and thence back into the high pressure chamber of the compressor housing, permitting the cooled fluid to cool the compressor. As shown, the precooled refrigerant is delivered into the housing subjacent the front head of the compressor.

Ludwig F. Funke, in U.S. Pat. No. 3,317,123, which patent is also owned by the assignee hereof, shows a compressor wherein the refrigerant is returned from a precooler through a return conduit into the sidewall of the compressor housing.

Leslie B. M. Buchanan, in U.S. Pat. No. 2,139,996, shows a compressor having means for pumping oil from the compressor sump through a conduit terminating above the motor and adjacent the compressor.

In U.S. Pat. No. 3,079,763, of Anthony C. Schneider et al, refrigerant contaminated oil is fed to a conventional cooling jacket of the compressor so as to be maintained in heat exchange relationship with the compressor and permitting the refrigerant entrained in the oil to be driven off for return to the interstage cooler. A constant liquid level is maintained in the jacket to provide a uniform compressor temperature.

Ralph Z. Fanberg, in U.S. Pat. No. 4,006,602, shows a refrigeration system wherein refrigerant liquid is directed in association with the compressor for cooling the compressor without the need of an oil cooler. The refrigerant is forced through passages to the hottest compressor portions for cooling the compressor so that the oil does not become excessively hot.

SUMMARY OF THE INVENTION

The present invention comprehends an improved refrigerant compressor system wherein the compressor is cooled by directing a mixture of precooled oil and refrigerant against the top surface of the rear compressor head.

The oil, which includes entrained refrigerant vapor upon being first discharged from the compressor, is deposited on the rear compressor head and is heated by heat transfer association with the compressor so as to drive off refrigerant from the oil.

The oil may be retained on the rear compressor head in upwardly opening recess means formed therein.

In the illustrated embodiment, the recess means defines a flow path wherein the oil may flow from an oil receiving portion to an oil delivery portion.

In the illustrated embodiment, the flow path is defined by a plurality of interconnected, upwardly opening recess chambers.

In the illustrated embodiment, the oil delivery portion of the flow path is in heat transfer association with a relatively hot portion of the compressor and the oil receiving portion is in heat transfer with a relatively cool portion. More specifically, in the illustrated embodiment, the oil delivery portion is in heat transfer association with the discharge outlet region of the compressor and the oil receiving portion is in heat transfer association with the suction inlet portion thereof.

The upwardly opening recesses of the rear head are interconnected by flow control passages for controlled flow of the oil from the oil receiving portion to the oil delivery portion of the flow path. The controlled flow path thus defined, and as shown in the illustrated embodiment, provides maximum cooling and, resultingly, provides a maximum improvement in compressor efficiency.

The refrigerant compressor of the present invention is extremely simple and economical of construction while yet providing improved operating efficiency, life, and reliability of the compressor as a result of the improved cooling and oilrefrigerant vapor separation thereof.

BRIEF DESCRIPTION OF THE DRAWING

Other features and advantages of the invention will be apparent from the following description taken in connection with the accompanying drawings wherein:

FIG. 1 is a section of a refrigerant compressor embodying the invention, taken along lines 1—1 of FIG. 2, and illustrating the connection of the precooler thereto;

FIG. 2 is a top plan view of the compressor assembly with a portion of the housing broken away to illustrate the invention in greater detail;

DESCRIPTION OF THE PREFERRED EMBODIMENT

Figure 3:
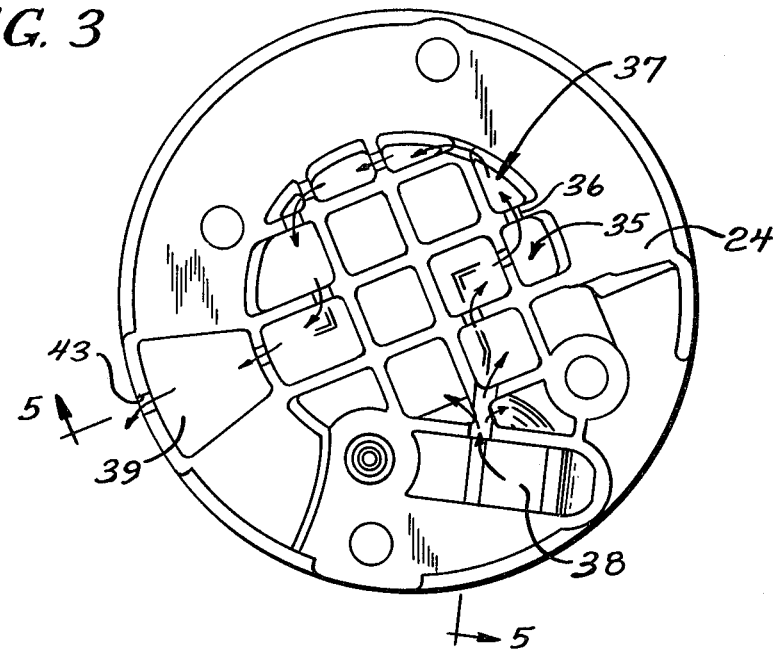
FIG. 3 is a horizontal section taken substantially along the line 3—3 of FIG. 1.

In the exemplary embodiment of the invention as disclosed in the drawings, a refrigerant compressor system generally designated 10 is shown to include a rotary compressor generally designated 11, having a housing 12. A compressor apparatus 13 is disposed within housing 12 on the upper end of a drive shaft 14 rotated by a suitable electric motor 15. The lower portion 16 of the housing defines a sump for collecting lubricating oil 17. The upper portion of the housing defines a top wall 18 which may be hermetically sealed to a portion 19 of the housing as by suitable welding 20.

The compressor apparatus 13 includes a front head 21, a compression cylinder 22, a rotor 23 on the upper end of shaft 14 in cylinder 22, and an upper wall defining the rear head 24. The rear head, cylinder, and front head may be retained in assembled relationship by suitable screws 25.

Refrigerant vapor in the refrigeration system is compressed in cylinder 22 by conventional action of the rotor 23 therein, and delivered to an outlet chamber 26 for flow through a series of muffler chambers 27 to a first discharge outlet 28 extending through the housing upper portion 18 for delivering the compressed refrigerant fluid to a conventional precooler 29. The precooled refrigerant is delivered from precooler 29 through a discharge return conduit 30 having a discharge end 31 opening through the top wall 18 downwardly toward the rear head 24, as seen in FIG. 1. The refrigerant vapor returned to the housing 12 under high pressure and subsequently is discharged therefrom through a second discharge outlet 32 to the refrigeration system. After passing through the refrigeration system, the refrigerant fluid is returned to the compressor through a suction inlet conduit 33 to enter the cylinder 22 at a suction portion 34 thereof.

As is conventional in rotary compressors, the compressed refrigerant vapor delivered to the precooler 29 from the first discharge outlet 28 includes fine particles of the oil that is provided for lubricating the compressor parts during the compression operation, and the oil particles themselves contain entrained refrigerant gas. Thus, the precooled fluid delivered through the outlet end 31 of conduit 30 includes oil droplets which impinge on the rear head 24 and serve to cool the rear head by their heat transfer association therewith.

As shown, rear head 24 defines a plurality of upwardly opening recesses 35, which serve as fluid reservoirs and which are interconnected by flow passages 36 to define a flow path generally designated 37 extending from an oil receiving recess 38 to an oil delivery recess 39.

Figure 4:
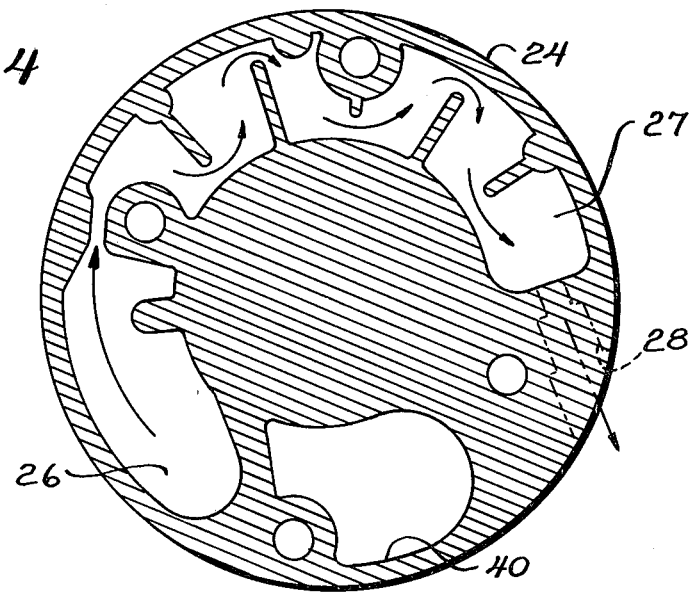
FIG. 4 is a horizontal section taken substantially along the line 4—4 of FIG. 1.

As shown in FIG. 4, rear head 24 further defines a suction chamber 40. As seen with reference to FIG. 3, oil receiving recess 38 of the oil flow path 37 is disposed in overlying relationship to the suction chamber 40 and oil delivery recess 39 of the oil flow path is disposed in overlying relationship to the outlet chamber of rear head 24. The temperature of the refrigerant fluid in the suction chamber is comparatively low, such as approximately 170° F., whereas the temperature of the refrigerant fluid after it has been compressed and delivered to the outlet chamber 26 is relatively high, such as approximately 250° F., in the conventional compressor of this type. The present invention permits the oil flowing over the rear head 24 to substantially lower the temperatures within the compressor so that the temperature in the suction chamber is approximately 140° F., and the temperature in the delivery outlet chamber 26 is approximately 220° F.

Figure 5:
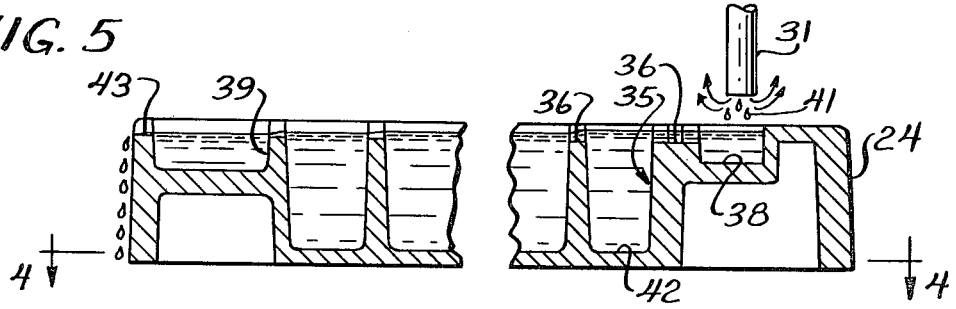
FIG. 5 is a vertical section taken substantially along the line 5—5 of FIG. 3.

More specifically, as shown in FIG. 5, the oil droplets 41 delivered with the precooled refrigerant fluid are directed into the first, oil receiving recess 38. When the level of oil therein reaches the level of the flow passage, or weir, 36, between recess 38 and the next recess 42 of the series of recesses 35, oil flows from recess 38 into recess 42 and subsequently flows to each of the other recesses over the control weirs therebetween to the oil delivery recess 39. As the oil flows from recess 38 to recess 39, it absorbs a sufficient amount of heat from the compressor to drive out, by evaporation, substantially all of the entrained refrigerant gas.

With reference to FIGS. 3 and 4, it can be seen that the oil flow path 37 provided on rear head 24 causes the returned oil to flow along a path that generally overlies and runs generally opposite to the path refrigerant follows as it flows through the chambers 27 within the rear head 24.

As shown in FIG. 1, the oil from which entrained refrigerant vapor has been evaporated as a result of the heat exchange of the oil with the hot rear head 24 during this flow, passes over the outlet weir 43 to fall downwardly to the sump 16 for reuse in lubricating the compressor mechanism.

It has been found that maximum efficiency in the heat transfer results from the delivery of the oil from the precooler against the portion of the rear head adjacent the suction chamber of the compressor, which portion defines the low temperature portion of the rear head. As a result of the flow of the oil along the flow path to the high temperature portion of the rear head adjacent the discharge area of the compressor, improved heat transfer causing substantially complete evaporation of the entrained refrigerant vapor from the oil is effected. Such removal of refrigerant gas from the lubricating oil provides for improved lubrication of the compressor mechanism. As discussed above, flow of the oil through the flow path is controlled by the successive weirs between the respective recesses 35 to maintain the oil in heat transfer association with the rear head sufficiently to remove substantially all of the entrained refrigerant vapor during the flow thereof over the rear head.

Not only is the elimination of refrigerant vapor from the lubricating oil substantially improved by the novel arrangement of the present invention, but further, the compressor is caused to operate at a lower temperature as a result of the improved heat transfer association of the returned precooled fluid from the precooler 29. In the illustrated embodiment, improved heat transfer is effected by causing flow of the lubricating oil on the rear head in a direction generally opposite to the flow of the refrigerant through the muffler system of the rear head. Thus, by utilization of the returned refrigerant from the precooler, improved cooling of the compressor mechanism is obtained.

The compressor cooling and lubricating oil-refrigerant vapor separating means of the present invention is extremely simple and economical of construction while yet providing substantial improvement in the operation of the compressor as discussed above.

The foregoing disclosure of specific embodiments is illustrative of the board inventive concepts comprehended by the invention.

Having described the invention, the embodiments of the invention in which an exclusive property or privilege is claimed are defined as follows:

1. In a refrigerant compressor system including a housing, a rotary compressor apparatus within said housing and defining a head, first discharge means for discharging compressed refrigerant/oil mixture from the compressor apparatus, and precooling means including a heat exchanger having an inlet connected to said first discharge means and an outlet connected to said housing to supply refrigerant/oil mixture thereinto for discharge of refrigerant vapor therefrom outwardly through a second discharge means, the improvement comprising:

means for directing the precooled refrigerant/oil mixture from said precooling means outlet into direct heat transfer association with said compressor head to cause evaporation of the refrigerant from said mixture.

2. The refrigerant compressor system of claim 1 wherein said housing defines a top wall and said precooling means outlet is connected to a conduit which passes through said housing top wall 3. The refrigerant compressor system of claim 1 wherein said housing defines a top wall and said precooling means outlet is connected to a conduit which passes through said housing top wall and defines a distal end spaced closely adjacent said compressor head for discharging the precooled refrigerant/oil mixture downwardly against said upper wall of the compressor.

4. In a refrigerant compressor system including a housing, a rotary compressor apparatus located within said housing, a rear head mounted on said compressor apparatus and having a high temperature portion and a low temperature portion, first discharge means for discharging compressed refrigerant/oil mixture from the compressor apparatus, second discharge means for discharging compressed refrigerant from the housing, and precooling means including a heat exchanger having an inlet connected to said first discharge means and an outlet connected to said housing for supplying refrigerant thereto for subsequent discharge of refrigerant therefrom outwardly through said second discharge means, the improvement comprising:

means for supplying precooled refrigerant/oil mixture from said precooling means outlet directly onto said low temperature portion of said rear head to cause evaporation of the refrigerant from said mixture.

5. The refrigerant compressor system of claim 4 wherein said rear head defines means for conducting the refrigerant oil mixture in a preselected flow path on said rear head for a period of time sufficient to cause evaporation of the refrigerant fluid therefrom as a result of said oil being heated by heat transfer from said rear head.

6. The refrigerant compressor system of claim 4 wherein said rear head defines an upwardly opening recess for conducting the refrigerant/oil mixture in a preselected flow path on said rear head for a period of time sufficient to cause evaporation of the refrigerant fluid therefrom as a result of said oil being heated by heat transfer from said rear head.

7. The refrigerant compressor system of claim 4 wherein said housing defines a lower oil sump portion, said rear head defines means for retaining oil entrained in the precooled refrigerant on said rear head for a period of time sufficient to cause evaporation of the refrigerant fluid therefrom as a result of said oil being heated by heat transfer from said rear head, and means for directing the oil from the retaining means after said refrigerant is evaporated therefrom to said sump portion of the housing.

8. The refrigerant compressor system of claim 4 wherein said rear head defines means for retaining oil entrained in the precooled refrigerant on said rear head for a period of time sufficient to cause evaporation of the refrigerant fluid therefrom as a result of said oil being heated by heat transfer from said rear head, said oil retaining means defining an oil flow path extending from said low temperature portion of said rear head to said high temperature portion, said housing defining a lower oil sump portion disposed to receive oil overflowing from said retaining means at said high temperature portion.

9. In a refrigerant compressor system having a suction inlet, a discharge outlet, and an upwardly facing wall portion overlying said inlet and said outlet, means for separating refrigerant fluid undesirably entrained in the lubrication oil utilized in lubricating the compressor during operation thereof, comprising:

means defining a flow path extending laterally across said upwardly facing wall between a portion of said wall overlying said inlet and a portion of said wall overlying said outlet to cause lubricating oil in said flow path to be in heat transfer association with said wall for evaporating refrigerant fluid from the oil therein for discharge from the compressor; and means for causing the compressor lubricating oil to flow through said flow path means.

10. The refrigerant compressor system of claim 9 wherein said flow path means comprises upwardly open recess means.

11. The refrigerant compressor system of claim 9 wherein said flow path means comprises a plurality of fluid reservoirs and flow control oil transfer passages interconnecting said reservoirs.

12. The refrigerant compressor system of claim 9 wherein said flow path means comprises a plurality of upwardly open, recessed areas in said upwardly facing wall and flow control oil transfer passages interconnecting the recessed areas.

13. The refrigerant compressor system of claim 9 wherein said oil delivering means supplies lubricating oil to said upwardly facing wall portion overlying said suction inlet and the delivered oil flows progressively along said flow path toward said wall portion overlying said outlet.

14. The refrigerant compressor system of claim 9 wherein said compressor defines a preselected refrigerant flow path for refrigerant being compressed thereby, said oil flow path means defining an oil receiving portion and an oil delivery portion, said oil receiving portion being in heat transfer association with the refrigerant in a first portion of the refrigerant flow path which is at a first temperature, and said oil delivery portion being in heat transfer association with the refrigerant in a second portion of the refrigerant flow path which is at a second temperature higher than said first temperature.

15. The refrigerant compressor system of claim 9 wherein said oil flow path means defines an oil receiving portion and an oil delivery portion, said oil receiving portion being in heat transfer association with refrigerant in said suction inlet which is at a first temperature, and said oil delivery portion being in heat transfer association with refrigerant in said discharge outlet which is at a second temperature higher than said first temperature.

16. In a rotary refrigerant compressor system having a cylinder, a rear head overlying said cylinder and including an upwardly facing outer surface, and means defining a refrigerant flow path within said rear head, the improvement comprising:

means defining a liquid flow path extending across said upwardly facing rear head surface and generally overlying said refrigerant flow path; and means for causing a flow of compressor lubricating oil through said liquid flow path during operation of said compressor in heat transfer association with the portion of said rear head which overlies said refrigerant flow path.

17. The rotary refrigerant compressor system of claim 16 wherein said liquid flow path and said oil delivery means are arranged to cause oil to flow along said liquid flow path in a direction generally opposite to the direction of refrigerant flow through said refrigerant flow path within said rear head.

18. The rotary refrigerant compressor system of claim 17 wherein said liquid flow path comprises a plurality of interconnected recesses formed in said upwardly facing rear head surface.

19. In a refrigerant compressor system including a housing having means defining an oil sump, a rotary compressor apparatus within said housing, first discharge means for discharging compressed refrigerant-/oil mixture from said compressor apparatus, second discharge means for discharging compressed refrigerant from said housing, suction inlet means for supplying refrigerant to said compressor apparatus and having means defining a refrigerant flow path extending internally through said rear head to said first discharge means, and a heat exchanger having an inlet connected to said first discharge means and having an outlet, the improvement comprising:

a plurality of interconnected upwardly open liquid reservoirs extending across said rear head to define a liquid flow path generally overlying said rear head refrigerant flow path;

a fluid conduit connected to said heat exchanger outlet and extending through said compressor housing and positioned to supply refrigerant/oil mixture received from said heat exchanger directly to said liquid flow path in a region generally adjacent said suction inlet for flow of the liquid through said flow path; and means associated with one of said interconnected fluid reservoirs spaced from said region for delivering liquid from said flow path to said sump.

20. The refrigerant compressor system of claim 19 wherein said reservoirs, said fluid supply conduit and said liquid delivery means are arranged to effect liquid flow along said liquid flow path in a direction generally opposite to the direction of refrigerant flow within said rear head refrigerant flow path.

* * * * *